US009002228B2

(12) United States Patent
Sakamaki et al.

(10) Patent No.: US 9,002,228 B2
(45) Date of Patent: Apr. 7, 2015

(54) IMAGE FORMING APPARATUS WITH CONTROL SECTION TO CONTROL CONTACT PRESSURE BETWEEN HEATING MEMBER AND PRESSURE MEMBER AND CONTROL METHOD THEREOF

(71) Applicants: Tsutomu Sakamaki, Tokyo (JP); Takashi Yamada, Tokyo (JP)

(72) Inventors: Tsutomu Sakamaki, Tokyo (JP); Takashi Yamada, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 14 days.

(21) Appl. No.: 13/845,991

(22) Filed: Mar. 18, 2013

(65) Prior Publication Data

US 2013/0272736 A1 Oct. 17, 2013

(30) Foreign Application Priority Data

Apr. 12, 2012 (JP) ..... 2012-091015
Sep. 21, 2012 (JP) ..... 2012-208184

(51) Int. Cl.
*G03G 15/20* (2006.01)
*G03G 15/16* (2006.01)

(52) U.S. Cl.
CPC ..... *G03G 15/205* (2013.01); *G03G 15/2067* (2013.01)

(58) Field of Classification Search
USPC ..... 399/67, 70, 122
See application file for complete search history.

(56) References Cited

U.S. PATENT DOCUMENTS

| | | | | |
|---|---|---|---|---|
| 6,078,781 | A * | 6/2000 | Takagi et al. | 399/330 |
| 6,097,926 | A * | 8/2000 | Takagi et al. | 399/328 |
| 6,347,201 | B1 * | 2/2002 | Sano et al. | 399/67 |
| 2005/0254845 | A1 * | 11/2005 | Taki et al. | 399/45 |
| 2007/0025750 | A1 * | 2/2007 | Ando | 399/67 |
| 2007/0059013 | A1 * | 3/2007 | Mori et al. | 399/69 |
| 2007/0230983 | A1 * | 10/2007 | Nakamoto et al. | 399/69 |
| 2008/0118264 | A1 * | 5/2008 | Mori et al. | 399/69 |
| 2008/0260405 | A1 * | 10/2008 | Carolan et al. | 399/67 |
| 2009/0060553 | A1 * | 3/2009 | Okabayashi | 399/70 |
| 2009/0238597 | A1 * | 9/2009 | Cao et al. | 399/70 |
| 2010/0034548 | A1 * | 2/2010 | Naitoh et al. | 399/69 |
| 2010/0111579 | A1 * | 5/2010 | Condello et al. | 399/329 |
| 2010/0166471 | A1 * | 7/2010 | Kikuchi | 399/331 |
| 2011/0052235 | A1 * | 3/2011 | Barton et al. | 399/69 |

(Continued)

FOREIGN PATENT DOCUMENTS

| | | | |
|---|---|---|---|
| JP | 60055370 | A | 3/1985 |
| JP | 2007108965 | A | 4/2007 |

*Primary Examiner* — David Bolduc
(74) *Attorney, Agent, or Firm* — Cantor Colburn LLP

(57) ABSTRACT

An image forming apparatus is provided that includes: a heating member that heats a recording sheet; a pressure member that presses the recording sheet between the heating member and the pressure member; an adjustment mechanism that causes the heating member and the pressure member to contact or to separate; and a control section that, at a time of a warm-up operation or an idling operation, based on a predetermined condition, controls the adjustment mechanism so as to cause the heating member and the pressure member to contact at a contact pressure that is lower than a contact pressure between the heating member and the pressure member at a time of image formation or is approximately identical to the contact pressure at a time of image formation.

4 Claims, 15 Drawing Sheets

(56) References Cited

U.S. PATENT DOCUMENTS

2011/0069984 A1* 3/2011 Watanabe ..... 399/67
2011/0085832 A1* 4/2011 Hasegawa et al. ..... 399/329
2011/0097122 A1* 4/2011 Okamoto ..... 399/329
2011/0268460 A1* 11/2011 Odate ..... 399/33
2011/0311249 A1* 12/2011 Kubota et al. ..... 399/44
2012/0093531 A1* 4/2012 Yuasa et al. ..... 399/67
2012/0237229 A1* 9/2012 Okamoto ..... 399/33
2012/0263487 A1* 10/2012 Itaya ..... 399/68

* cited by examiner

| CONTACT PRESSURE [N] | DEFORMATION RATE [%] | BREAKING TIME [h] |
|---|---|---|
| 3500 | 40 | 10 |
| 3000 | 35 | $10^2$ |
| 2500 | 30 | $10^3$ |
| 1500 | 20 | $10^4$ |
| 300 | 10 | $10^6$ |

FIG. 6

| ΔT[°C] | 5～10 | 10～20 | 20～ |
|---|---|---|---|
| CONTACT TIME PERIOD [s] | 30 | 60 | 90 |

FIG. 8

| CORED BAR TEMPERATURE [°C] | ~30 | 30~50 | 50~ |
|---|---|---|---|
| CONTACT TIME PERIOD [s] | 90 | 60 | 30 |

FIG. 9

IMAGE FORMING APPARATUS WITH CONTROL SECTION TO CONTROL CONTACT PRESSURE BETWEEN HEATING MEMBER AND PRESSURE MEMBER AND CONTROL METHOD THEREOF

CROSS REFERENCE TO RELATED APPLICATIONS

This application is entitled and claims the benefit of Japanese Patent Application No. 2012-091015, filed on Apr. 12, 2012, and No. 2012-208184, filed on Sep. 21, 2012, the disclosures of which including the specification, drawings and abstract are incorporated herein by reference in their entirety.

BACKGROUND OF THE INVENTION

1. Field of the Invention

The present invention relates to an image forming apparatus and a control method thereof.

2. Description of Related Art

A fixing apparatus that fixes a toner image that has been formed on a sheet based on inputted image data is provided in image forming apparatuses such as printers, copiers, fax machines, and multifunction machines that are provided with a combination of the aforementioned functions. In the fixing apparatus, a sheet on which a toner image has been formed is sandwiched between a heating member (for example, a fixing roller and/or a fixing belt) and a pressure member (for example, a pressure roller), and the sheet is heated while the heating member and the pressure member are pressed against each other to thereby fix the toner image to the sheet.

When a heater is not provided on the pressure member side, or when a heater is provided but the temperature raising capacity of the heater is low, in some cases there may be a large temperature difference between the heating member and the pressure member when starting printing. At this time, if the pressure member is pressed against the heating member as a warming up operation before starting printing, there is a possibility that the temperature of the heating member will drop significantly and a fixing failure will occur.

FIG. 15 illustrates the manner in which the respective temperatures of a heating member and a pressure member change with respect to before and after the heating member and the pressure member are pressed against each other. In FIG. 15, curve L0 illustrates a temperature change of the heating member, and curve L1 illustrates a temperature change of the pressure member. In the example shown in FIG. 15, a heater is not provided on the pressure member side, that is, temperature control of the pressure member is not performed. Consequently, the temperature of the pressure member prior to being pressed against the heating member is a low temperature of approximately 50° C. Accordingly, when the heating member is pressed against the pressure member, the temperature of the heating member falls by 15° C. or more, and a fixing failure occurs due to an insufficient rise in temperature.

Technology that has been proposed in relation to fixing apparatuses includes technology that is capable of shortening a warm-up time period of a fixing apparatus (for example, see Japanese Patent Application Laid-Open No. 2007-108965). According to the technology disclosed in Japanese Patent Application Laid-Open No. 2007-108965, a heating member and a pressure member are placed in a press-contacting state by a contact/separation mechanism, and only a heating section on the heating member side is energized. When the temperature of the heating member rises to a temperature that is close to a target temperature, the heating member and the pressure member are rotationally driven. Thereafter, when the temperature of the pressure member has risen to a temperature that is close to the target temperature, the heating member and the pressure member are placed in a separated state by the contact/separation mechanism. By adopting this configuration, the temperature of the heating member and the temperature of the pressure member can be efficiently raised as far as the target temperature by utilizing only the heating section on the heating member side. By applying the technology disclosed in Japanese Patent Application Laid-Open No. 2007-108965, a temperature difference between a heating member and a pressure member when printing starts decreases, and the temperature of the heating member does not fall significantly when the heating member and the pressure member are brought into press contact with each other, and hence the occurrence of a fixing failure can be prevented.

However, according to the technology disclosed in the above described Japanese Patent Application Laid-Open No. 2007-108965, because the heating member is always pressed against by the pressure member at the time of a warm-up operation before printing starts, a permanent deformation is liable to occur in the heating member and the durability thereof is liable to deteriorate.

SUMMARY OF THE INVENTION

It is an object of the present invention to provide an image forming apparatus that can prevent a fixing failure with respect to a toner image and also reduce deterioration in the durability of a heating member, as well as a method of controlling the image forming apparatus.

To achieve at least one of the abovementioned objects, an image forming apparatus reflecting one aspect of the present invention includes:

a heating member that heats a recording sheet;

a pressure member that presses the recording sheet between the heating member and the pressure member;

an adjustment mechanism that causes the heating member and the pressure member to contact or to separate; and a control section that, at a time of a warm-up operation or an idling operation, based on a predetermined condition, controls the adjustment mechanism so as to cause the heating member and the pressure member to contact at a contact pressure that is lower than a contact pressure between the heating member and the pressure member at a time of image formation or is approximately identical to the contact pressure at a time of image formation.

Preferably, the above described image forming apparatus includes:

a temperature sensor that detects a temperature of the pressure member;

and the control section controls the adjustment mechanism based on a temperature detection value from the temperature sensor at a time of the warm-up operation or the idling operation.

Preferably, the above described image forming apparatus includes:

a temperature sensor that detects a temperature of the heating member or the pressure member;

and in the image forming apparatus the predetermined condition is a temperature detection value from the temperature sensor, and at a time of the warm-up operation or the idling operation, if a temperature detection value from the temperature sensor is less than a predetermined temperature, the control section controls the adjustment mechanism so as to cause the heating member and the pressure member to contact at a contact pressure that is approximately identical to a contact pressure between the heating member and the pressure member at a time of image formation, while if the temperature detection value from the temperature sensor is greater than or equal to the predetermined temperature, the control section controls the adjustment mechanism so as to cause the heating member and the pressure member to contact at a contact pressure that is lower than a contact pressure between the heating member and the pressure member at a time of image formation.

Preferably, in the above described image forming apparatus:

the predetermined condition is an elapsed time after power-off of the image forming apparatus; and at a time of the warm-up operation or the idling operation, if an elapsed time after power-off of the image forming apparatus is greater than or equal to a predetermined time, the control section controls the adjustment mechanism so as to cause the heating member and the pressure member to contact at a contact pressure that is approximately identical to a contact pressure between the heating member and the pressure member at a time of image formation, while if the elapsed time is less than the predetermined time, the control section controls the adjustment mechanism so as to cause the heating member and the pressure member to contact at a contact pressure that is lower than a contact pressure between the heating member and the pressure member at a time of image formation.

Preferably, in the above described image forming apparatus:

the control section compares a temperature detection value from the temperature sensor and a target temperature, and controls the adjustment mechanism so as to cause the heating member and the pressure member to contact until a temperature of the pressure member reaches the target temperature.

Preferably, the above described image forming apparatus includes:

a heating source that heats the pressure member;

and the control section turns on power to the heating source at a time of the warm-up operation or the idling operation.

A control method of an image forming apparatus reflecting another aspect of the present invention is a control method of an image forming apparatus that includes:

a heating member that heats a recording sheet;

a pressure member that presses the recording sheet between the heating member and the pressure member; and an adjustment mechanism that causes the heating member and the pressure member to contact or separate;

in which, at a time of a warm-up operation or an idling operation, based on a predetermined condition, a control section controls the adjustment mechanism so as to cause the heating member and the pressure member to contact at a contact pressure that is lower than a contact pressure between the heating member and the pressure member at a time of image formation or is approximately identical to the contact pressure at a time of image formation.

Preferably, in the above described control method, the image forming apparatus includes a temperature sensor that detects a temperature of the pressure member;

and the control section controls the adjustment mechanism based on a temperature detection value from the temperature sensor at a time of the warm-up operation or the idling operation.

Preferably, in the above described control method, the image forming apparatus includes a temperature sensor that detects a temperature of the heating member or the pressure member;

the predetermined condition is a temperature detection value from the temperature sensor; and at a time of the warm-up operation or the idling operation, if a temperature detection value from the temperature sensor is less than a predetermined temperature, the control section controls the adjustment mechanism so as to cause the heating member and the pressure member to contact at a contact pressure that is approximately identical to a contact pressure between the heating member and the pressure member at a time of image formation, while if the temperature detection value from the temperature sensor is greater than or equal to the predetermined temperature, the control section controls the adjustment mechanism so as to cause the heating member and the pressure member to contact at a contact pressure that is lower than a contact pressure between the heating member and the pressure member at a time of image formation.

Preferably, in the above described control method, the predetermined condition is an elapsed time after power-off of the image forming apparatus; and at a time of the warm-up operation or the idling operation, if an elapsed time after power-off of the image forming apparatus is greater than or equal to a predetermined time, the control section controls the adjustment mechanism so as to cause the heating member and the pressure member to contact at a contact pressure that is approximately identical to a contact pressure between the heating member and the pressure member at a time of image formation, while if the elapsed time is less than the predetermined time, the control section controls the adjustment mechanism so as to cause the heating member and the pressure member to contact at a contact pressure that is lower than a contact pressure between the heating member and the pressure member at a time of image formation.

Preferably, in the above described control method, the control section compares a temperature detection value from the temperature sensor and a target temperature, and controls the adjustment mechanism so as to cause the heating member and the pressure member to contact until a temperature of the pressure member reaches the target temperature.

Preferably, in the above described control method, the image forming apparatus includes a heating source that heats the pressure member;

and the control section turns on power to the heating source at a time of the warm-up operation or the idling operation.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein:

FIG. 6 shows the result of a breakage endurance test conducted on a fixing roller;

FIG. 8 illustrates a modification of contact times between a fixing belt and fixing roller and a pressure roller;

FIG. 9 illustrates a modification of contact times between a fixing belt and fixing roller and a pressure roller;

DESCRIPTION OF THE PREFERRED EMBODIMENTS

Embodiments of the present invention will now be described in detail with reference to the accompanying drawings.

Embodiment 1

Figure 1:
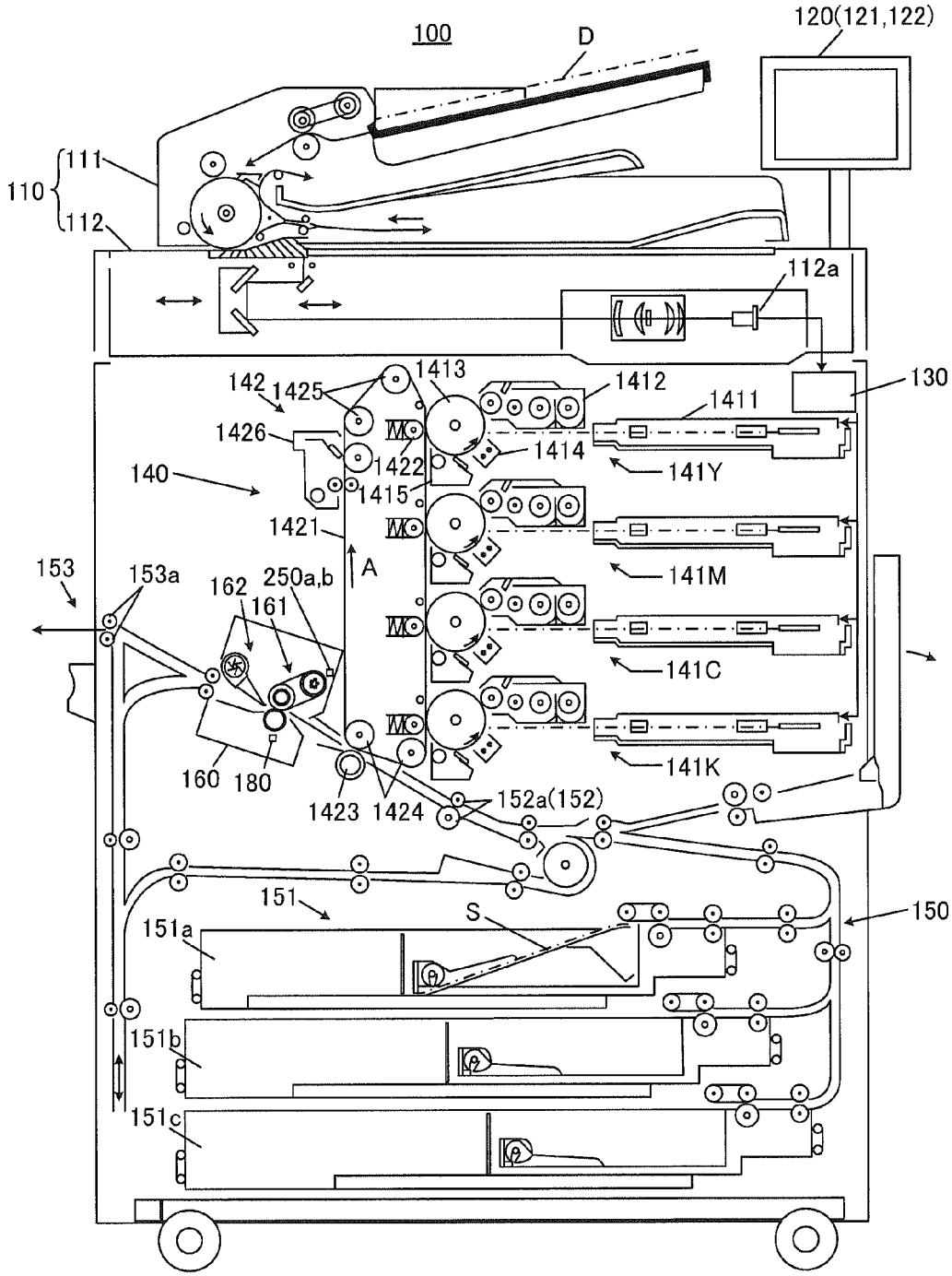
FIG. 1 is a longitudinal sectional view showing an image forming apparatus that illustrates Embodiment 1 according to the present invention.
Figure 2:
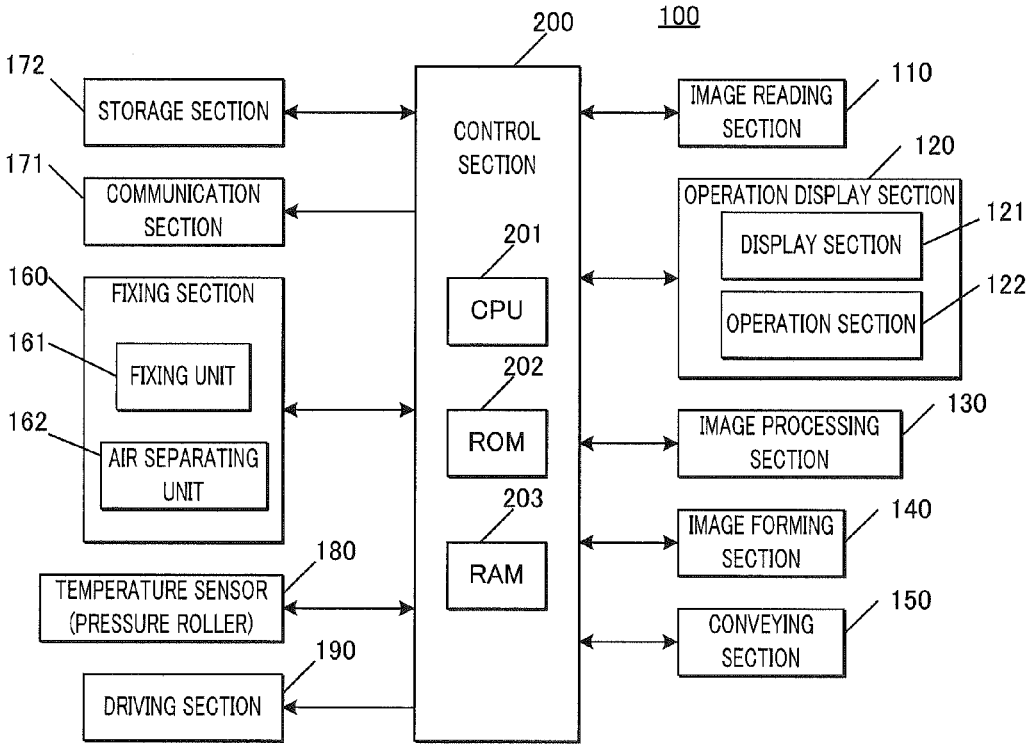
FIG. 2 is a control block diagram of the image forming apparatus that illustrates Embodiment 1 according to the present invention.

Image forming apparatus 100 shown in FIGS. 1 and 2 is an intermediate transfer-type color image forming apparatus that employs an electrophotographic process. That is, image forming apparatus 100 transfers toner images corresponding to four colors of cyan (C), magenta (M), yellow (Y), and black (K) that are formed on photoconductors onto an intermediate transfer body (primary transfer), and after superimposing toner images of four colors on the intermediate transfer body, transfers the superimposed toner images onto a sheet (secondary transfer) to thereby form an image.

Image forming apparatus 100 adopts a tandem system in which photoconductors corresponding to the four colors of CMYK are arranged in series in a traveling direction of the intermediate transfer body, and toner images of the respective colors are successively transferred onto the intermediate transfer body in one process.

As shown in FIGS. 1 and 2, image forming apparatus 100 includes image reading section 110, operation display section 120, image processing section 130, image forming section 140, conveying section 150, fixing section 160 and control section 200. Temperature sensor 180 and driving section 190 are described in detail later.

Control section 200 includes CPU (Central Processing Unit) 201, ROM (Read Only Memory) 202 and RAM (Random Access Memory) 203. CPU 201 reads out a program in accordance with the processing contents from ROM 202 and expands the program in RAM 203, and operates in conjunction with the expanded program to centrally control the operations of the respective blocks of image forming apparatus 100. At this time, various kinds of data stored in storage section 172 are referred to. For example, storage section 172 is composed of, for example, a nonvolatile semiconductor memory (a so-called "flash memory") or a hard disk drive.

Control section 200 performs transmission and reception of various kinds of data to and from an external apparatus (e.g., a personal computer) connected to a communication network such as a local area network (LAN) or wide area network (WAN), through communication section 171. Control section 200, for example, receives image data that is transmitted from the external apparatus, and an image is formed on a sheet based on the image data (input image data). For example, communication section 171 is composed of a communication control card such as a LAN card.

Image reading section 110 includes automatic document feeding apparatus 111 that is called an auto document feeder (ADF), document image scanning apparatus (scanner) 112, and the like.

Automatic document feeding apparatus 111 conveys an original document D placed on a document tray using a conveying mechanism and delivers the original document D to document image scanning apparatus 112. Automatic document feeding apparatus 111 can allow images (including images on both sides) of a large number of original documents D placed on the document tray to be read continuously and collectively.

Document image scanning apparatus 112 optically scans an original document conveyed onto a contact glass from automatic document feeding apparatus 111 or an original document placed on the contact glass, focuses reflected light from the original document on a light receiving surface of charge coupled device (CCD) sensor 112*a*, and reads a document image. Image reading section 110 generates input image data based on the scanning result obtained by document image scanning apparatus 112. The input image data is subjected to predetermined image processing in image processing section 130.

Operation display section 120 is composed of, for example, a touch panel liquid crystal display (LCD), and functions as display section 121 and operation section 122. Display section 121 displays various operation screens, a state of an image, operation states of respective functions and the like according to a display control signal input from control section 200. Operation section 122 includes various operation keys such as a numeric keypad and a start key. Operation section 122 accepts various kinds of input operations by a user and outputs an operation signal to control section 200.

Image processing section 130 includes a circuit for performing digital image processing in accordance with initial settings or user setting with respect to input image data and the like. For example, under the control of control section 200, image processing section 130 performs gradation correction based on gradation correction data (a gradation correction table). Further, in addition to gradation correction, image processing section 130 applies various kinds of correction processing such as color correction and shading correction processing, and compression processing and the like to the input image data. Image forming section 140 is controlled based on image data that has been subjected to these kinds of processing.

Image forming section 140 includes image forming units 141Y, 141M, 141C and 141K and intermediate transfer unit 142 and the like for forming an image using respective colored toners of a Y component, an M component, a C component and a K component based on the input image data.

Image forming units 141Y, 141M, 141C and 141K for the Y component, M component, C component and K component, respectively, have the same configuration. To facilitate the diagrammatic representation and description, common constituent elements are denoted by the same reference symbols, and the character Y, M, C or K is affixed to the relevant reference symbol when distinguishing between common constituent elements. In FIG. 1, reference symbols are assigned to only the constituent elements of image forming unit 141Y for the Y component, and reference symbols are omitted for the constituent elements of image forming units 141M, 141C and 141K.

The configuration of the image forming unit 141 will now be described referring to image forming unit 141Y. Image forming unit 141Y includes exposing apparatus 1411, developing apparatus 1412, photoconductor drum 1413, charging apparatus 1414 and drum cleaning apparatus 1415.

Photoconductor drum 1413, for example, is a negatively chargeable organic photoconductor (OPC) in which an under coat layer (UCL), a charge generation layer (CGL) and a charge transport layer (CTL) are laminated in succession on a peripheral surface of a conductive cylindrical body (aluminum tube) made of aluminum.

Charging apparatus 1414 uniformly charges the surface of photoconductor drum 1413 that has photoconductivity with a negative polarity. Exposing apparatus 1411 includes, for example, a semiconductor laser. Exposing apparatus 1411 directs a laser beam corresponding to an image of the respective color components onto photoconductor drum 1413. Consequently, a positive charge is generated on the charge generation layer of photoconductor drum 1413, and by conveying the charge as far as the surface of the charge transport layer, the surface charge (negative charge) of photoconductor drum 1413 is neutralized. An electrostatic latent image of each of the color components is formed on the surface of photoconductor drum 1413 by a potential difference with respect to the surrounding area.

Developing apparatus 1412 has stored therein a developer (e.g., a two-component developer containing a small particle size toner and a magnetic carrier) of the respective color components. Developing apparatus 1412 deposits toner of the respective color components on the surface of photoconductor drum 1413 to thereby visualize the electrostatic latent images and form toner images.

Drum cleaning apparatus 1415 includes a drum cleaning blade that is brought into sliding contact with the surface of photoconductor drum 1413. Transfer residue toner that remains on the surface of photoconductor drum 1413 after the primary transfer is scraped off and removed by the drum cleaning blade.

Intermediate transfer unit 142 includes intermediate transfer belt 1421 that functions as an intermediate transfer body, primary transfer roller 1422, secondary transfer roller 1423, drive rollers 1424, driven rollers 1425 and belt cleaning apparatus 1426.

Intermediate transfer belt 1421 is configured as an endless belt, and is looped around drive rollers 1424 and driven rollers 1425. Intermediate transfer belt 1421 travels at a constant speed in the direction of arrow A by rotation of drive rollers 1424. When intermediate transfer belt 1421 is brought into press contact with photoconductor drum 1413 by primary transfer roller 1422, the toner images of the respective colors are successively superimposed on intermediate transfer belt 1421 to thereby undergo primary transfer onto intermediate transfer belt 1421. Subsequently, when intermediate transfer belt 1421 is brought into press contact with sheet S by means of secondary transfer roller 1423, the toner images that been primarily transferred onto intermediate transfer belt 1421 undergo secondary transfer onto sheet S.

Belt cleaning apparatus 1426 includes a belt cleaning blade that is brought into sliding contact with the surface of intermediate transfer belt 1421. Transfer residue toner that remains on the surface of intermediate transfer belt 1421 after the secondary transfer is scraped off and removed by the belt cleaning blade.

Fixing section 160 heats and presses the conveyed sheet S at a fixing nip section, to thereby fix the toner images to sheet S. Fixing section 160 is an air separation-type fixing apparatus that includes fixing unit 161 and air separating unit 162. Fixing unit 161 causes sheet S to pass through the fixing nip section that is formed by bringing a pair of fixing members into press contact, and fixes the toner images to sheet S by applying heat from a heat source to the toner images that have been transferred onto sheet S. Air separating unit 162 separates sheet S from the fixing members by blowing a gas at sheet S from a paper discharge side of sheet S in the fixing nip section.

Conveying section 150 includes paper feeding section 151, conveying mechanism 152 and paper discharge section 153 and the like. Paper feeding section 151 includes three paper feeding tray units 151*a* to 151*c*. In paper feeding tray units 151*a* to 151*c*, sheets (standard sheets and special sheets) S identified based on the basis weights, the sizes, and the like of the sheets are stored for each of the types set in advance.

Sheets S stored in paper feeding tray units 151*a* to 151*c* are delivered one by one from the uppermost sheet S. Sheet S is conveyed to image forming section 140 by conveying mechanism 152 including a plurality of conveying rollers such as registration roller 152*a*. At this point, the tilt of fed sheet S is corrected and the conveyance timing is adjusted by a registration section in which registration roller 152*a* is disposed. In image forming section 140, the toner images on intermediate transfer belt 1421 collectively undergo secondary transfer onto one of the surfaces of sheet S, and are subjected to a fixing process at fixing section 160. Sheet S on which an image has been formed is discharged to outside the apparatus by paper discharge section 153 including paper discharge rollers 153*a*.

Figure 3:
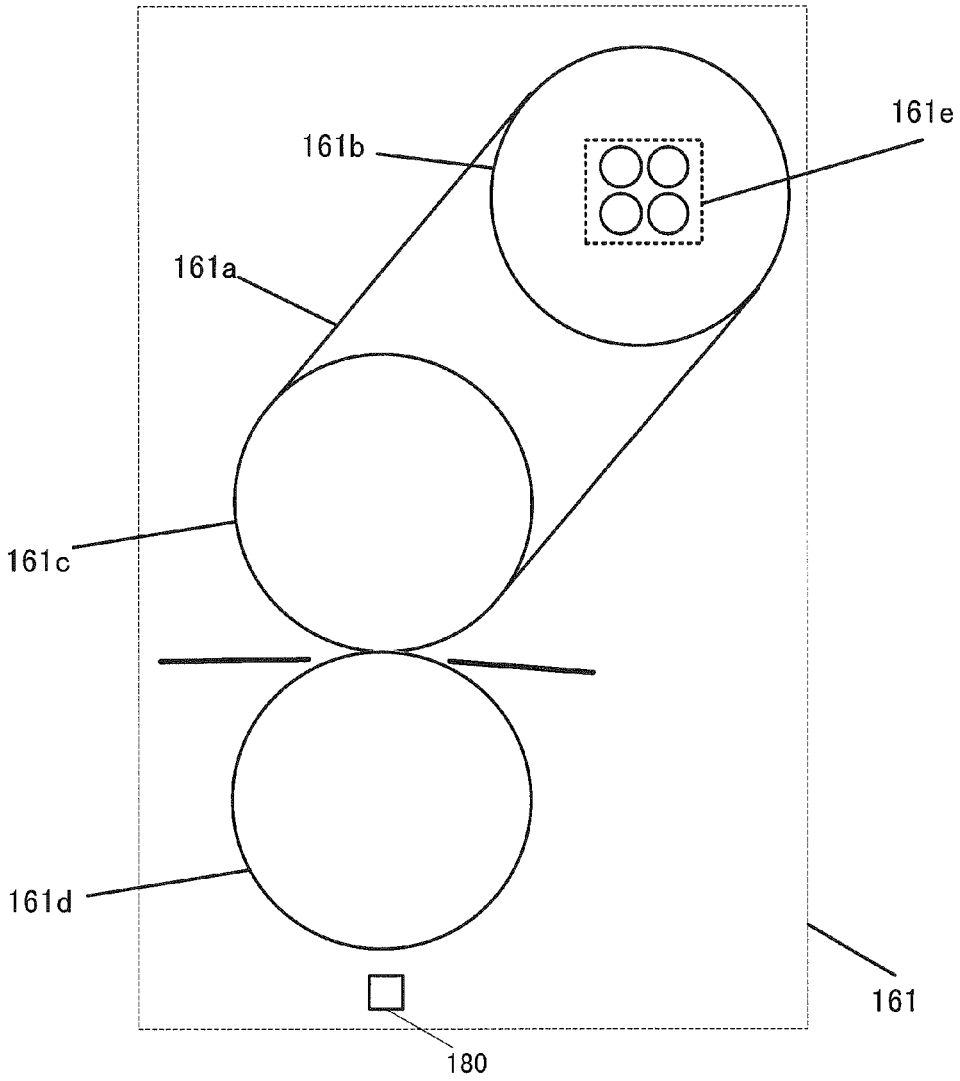
FIG. 3 shows a configuration in the vicinity of a fixing unit that illustrates Embodiment 1 according to the present invention.

Next, the configuration in the vicinity of fixing unit 161 will be described referring to FIG. 3. As shown in FIG. 3, fixing unit 161 is configured according to a belt heating system. That is, fixing unit 161 includes an upper-side pressing section and a lower-side pressing section that form the fixing nip section.

The upper-side pressing section includes heating roller 161*b* and fixing roller 161*c*. Endless fixing belt 161*a* is looped with a predetermined belt tension (for example, 250 N) between heating roller 161*b* and fixing roller 161*c*. Fixing belt 161*a* and fixing roller 161*c* function as a heating member.

The lower-side pressing section includes pressure roller 161*d* that functions as a pressure member. Pressure roller 161*d* is pressed with a predetermined fixing load (for example, 1500 N) against fixing roller 161*c* through fixing belt 161*a*. Thus, a fixing nip section that sandwiches and conveys sheet S is formed between fixing roller 161*c* and pressure roller 161*d*.

Fixing belt 161*a* contacts sheet S on which toner images are formed and heats sheet S at a fixing temperature (for example, 160 to 200° C.). The term "fixing temperature" refers to a temperature that can supply a quantity of heat that is required to melt the toner on sheet S, and the fixing temperature differs according to the kind of paper of the sheet on which an image is to be formed.

For example, PI (polyimide) having a thickness of 70 μm is used as a base body of fixing belt 161*a*. The outer circumferential face of the base body is covered with heat resistant silicone rubber (hardness: JIS-A 30°) of a thickness of 200 μm as an elastic layer, and is further coated with PFA (perfluoroalkoxy), which is a heat resistant resin, to a thickness of 30 μm as a surface layer. The outer diameter is, for example, 120 mm.

Heating roller 161*b* heats fixing belt 161*a*. Heating roller 161*b* incorporates halogen heater 161*e* that heats fixing belt 161*a*. Halogen heater 161*e*, for example, is constituted by covering the outer circumferential face of a cylindrical cored bar having a wall thickness of 4 mm formed of aluminum or the like with a resin layer coated with PTFE having a thickness of 30 μm. The outer diameter is, for example, 70 mm. To conform to various sheet widths, halogen heater 161*e* incorporates, for example, two 1200-watt heaters, two 750-watt heaters, and one 500-watt heater, and the heaters are arranged so as to ensure different heat generation distributions in the axial direction to correspond to different widths of sheets S.

The temperature of halogen heater 161*e* is controlled by control section 200. Heating roller 161*b* is heated by halogen heater 161*e*, and as a result, fixing belt 161*a* is heated. A configuration may also be adopted in which fixing belt 161*a* is heated by induction heating (IH).

Fixing roller 161*c* constitutes a pressing section for forming the fixing nip section together with pressure roller 161*d*. Driving control (for example, turning rotation on/off, the number of rotations and the like) of fixing roller 161*c* is performed by control section 200.

Fixing roller 161*c* is formed, for example, by covering a solid cored bar formed of a metal such as iron with heat-resistant silicone rubber (hardness: JIS-A 10°) of a thickness of 20 mm that serves as an elastic layer, and further covering the elastic layer with a resin layer coated with PTFE that is a low friction and heat resistant resin with a thickness of 30 μm. The outer diameter is, for example, 70 mm.

Pressure roller 161*d* constitutes a pressing section for forming the fixing nip section together with fixing roller 161*c*. Pressure roller 161*d* is pressed against fixing roller 161*c* through fixing belt 161*a*. Driving control (for example, turning rotation on/off, the number of rotations and the like) of pressure roller 161*d* is performed by control section 200.

Pressure roller 161*d* is formed, for example, by covering the outer circumferential face of a cylindrical cored bar having a wall thickness of 4 mm formed of aluminum or the like with heat resistant silicone rubber (hardness: JIS-A 30°) of a thickness of 1 mm that serves as an elastic layer, and further covering the elastic layer with a resin layer formed of a PFA tube of a thickness of 30 μm. The outer diameter is 70 mm.

A fixing speed in fixing unit 161 is, for example, 460 mm/s. As used herein, the term "fixing speed" refers to a speed at which sheet S passes through the fixing nip section formed by fixing roller 161*c* and pressure roller 161*d*.

Figure 4:
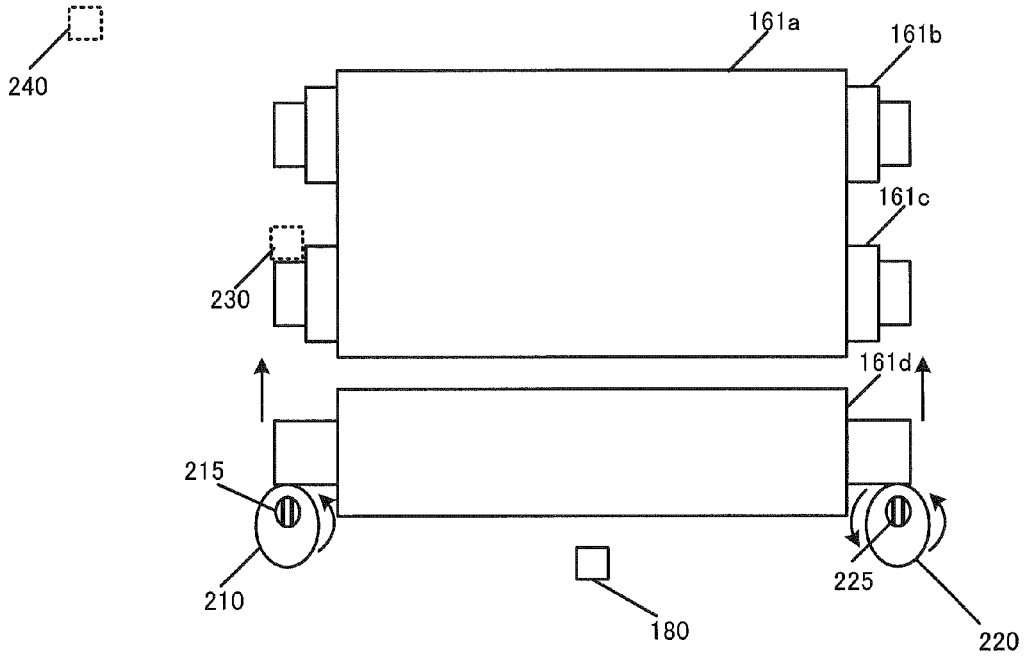
FIG. 4 shows a configuration in the vicinity of a fixing unit that illustrates Embodiment 1 according to the present invention.

As shown in FIG. 4, temperature sensor 180 for detecting the temperature of pressure roller 161*d* is provided at a portion on the underside of pressure roller 161*d*. Temperature sensor 180 detects the temperature of pressure roller 161*d* and outputs the detected temperature information to control section 200.

Slide cams 210 and 220 are provided at both ends of pressure roller 161*d*. Slide cams 210 and 220 can rotate around support points 215 and 225, respectively. Driving section 190 causes slide cams 210 and 220 to rotate upon receiving a drive command from control section 200. For example, driving section 190 is constituted by a combination of a motor and a gear. Note that, driving section 190 functions as an adjustment mechanism.

FIG. 4 illustrates a state in which fixing belt 161*a* and pressure roller 161*d* are separated at a time that a toner image is not being fixed to sheet S. When fixing a toner image to sheet S (a time of image formation), driving section 190 causes slide cams 210 and 220 to rotate, and as a result pressure roller 161*d* moves in the upward direction in the drawing as indicated by an arrow, and is pressed against fixing roller 161*c* through fixing belt 161*a*. Thus, the fixing nip section is formed.

According to the present embodiment, at the time of a warm-up operation of image forming apparatus 100, if the temperature of pressure roller 161*d* is significantly lower than a target temperature for a time of image formation, control section 200 causes fixing belt 161*a* and fixing roller 161*c* to contact pressure roller 161*d* until the temperature of pressure roller 161*d* reaches a temperature that is close to the target temperature. More specifically, control section 200 causes fixing belt 161*a* and fixing roller 161*c* to contact pressure roller 161*d* at a contact pressure (for example, 300 N) that is lower than a contact pressure (for example, 1500 N) at which fixing belt 161*a* and fixing roller 161*c* contact pressure roller 161*d* at a time of image formation.

Figure 5:
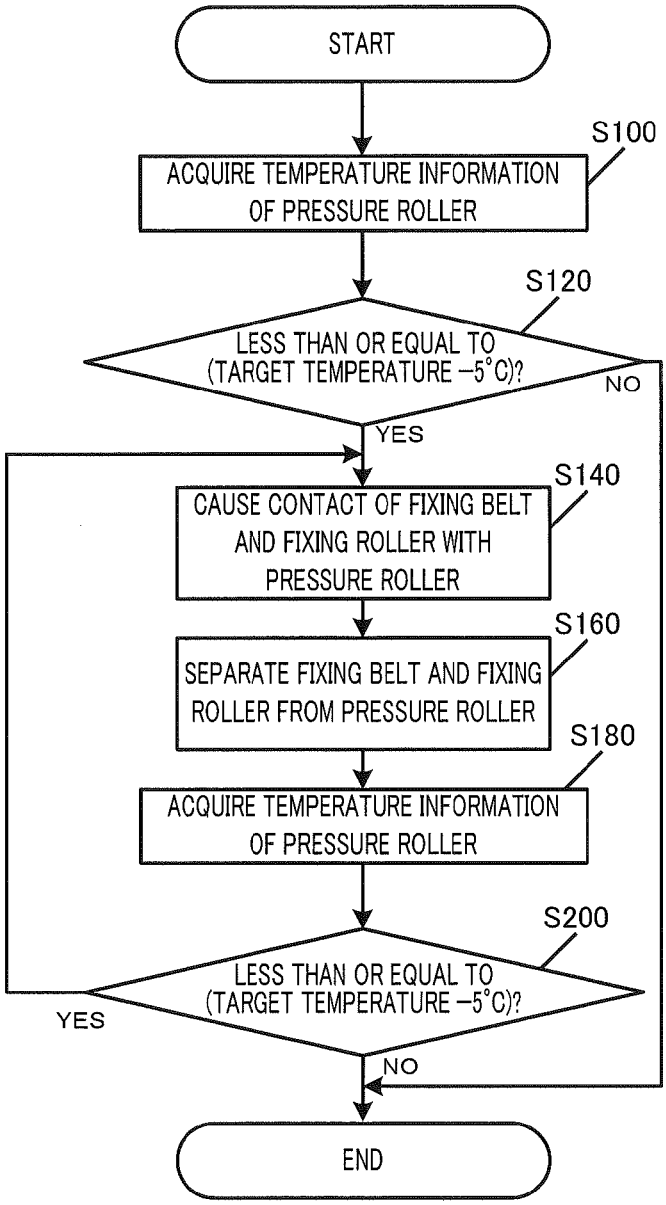
FIG. 5 is a flowchart showing an example of operations of the image forming apparatus that illustrates Embodiment 1 according to the present invention.

FIG. 5 is a flowchart that shows an example of operations of image forming apparatus 100 at the time of a warm-up operation of image forming apparatus 100 according to Embodiment 1. It is assumed that heating of fixing belt 161*a* by halogen heater 161*e* is started before performing the processing in step S100.

First, control section 200 acquires temperature information of pressure roller 161*d* that is outputted from temperature sensor 180 (step S100). Next, control section 200 determines whether or not the temperature indicated by the acquired temperature information is less than or equal to a temperature obtained by subtracting 5° C. from a target temperature of pressure roller 161*d* at a time of image formation (step S120).

If control section 200 determines that the indicated temperature is not less than or equal to the temperature obtained by subtracting 5° C. from the target temperature (NO in step S120), image forming apparatus 100 ends the processing illustrated in FIG. 5. In contrast, if control section 200 determines that the indicated temperature is less than or equal to the temperature obtained by subtracting 5° C. from the target temperature (YES in step S 120), control section 200 controls driving section 190 to cause fixing belt 161*a* and fixing roller 161*c* to contact pressure roller 161*d* for 30 seconds at a contact pressure (for example, 300 N) that is lower than a contact pressure (for example, 1500 N) at which fixing belt 161*a* and fixing roller 161*c* contact pressure roller 161*d* at a time of image formation (step S 140).

Next, control section 200 controls driving section 190 to separate fixing belt 161*a* and fixing roller 161*c* from pressure roller 161*d* (step S160). Subsequently, control section 200 acquires temperature information of pressure roller 161*d* that is outputted from temperature sensor 180 (step S180). Next, control section 200 determines whether or not the temperature indicated by the acquired temperature information is less than or equal to the temperature obtained by subtracting 5° C. from the target temperature of pressure roller 161*d* at a time of image formation (step S200).

If control section 200 determines that the indicated temperature is less than or equal to the temperature obtained by subtracting 5° C. from the target temperature (YES in step S200), the processing transitions to step S140. In contrast, if control section 200 determines that the indicated temperature is not less than or equal to the temperature obtained by subtracting 5° C. from the target temperature (NO in step S200), since it can be considered that pressure roller 161*d* has reached a temperature that will not significantly decrease the temperature of fixing belt 161*a* even if pressure roller 161*d* contacts fixing belt 161*a* thereafter, image forming apparatus 100 ends the processing illustrated in FIG. 5.

FIG. 6 shows results obtained when fixing roller 161*c* was subjected to a breakage endurance test. As the test conditions, the temperature of fixing roller 161*c* was controlled to 200° C. by halogen heater 161*e*, and pressure roller 161*d* was pressed with a predetermined pressure against fixing belt 161*a*. FIG. 6 shows the relationship between the contact pressure between pressure roller 161*d* and fixing belt 161*a* (deformation rate of the silicone rubber of fixing roller 161*c*) and the time until fixing roller 161*c* is broken.

As shown in FIG. 6, when the contact pressure between pressure roller 161*d* and fixing belt 161*a* was 3500 N, fixing roller 161*c* was broken in 10 hours. When the contact pressure between pressure roller 161*d* and fixing belt 161*a* was 3000 N, fixing roller 161*c* was broken in $10^2$ hours. When the contact pressure between pressure roller 161*d* and fixing belt 161*a* was 2500 N, fixing roller 161*c* was broken in $10^3$ hours.

In addition, when the contact pressure between pressure roller 161*d* and fixing belt 161*a* was 1500 N, fixing roller 161*c* was broken in $10^4$ hours. Further, when the contact pressure between pressure roller 161*d* and fixing belt 161*a* was 300 N, fixing roller 161*c* was broken in $10^6$ hours. Note that, the breaking time when the contact pressure between pressure roller 161*d* and fixing belt 161*a* was 1500 N or 300 N is a time that was estimated by obtaining an approximate expression showing breaking times when the contact pressure is from 3500 N to 2500 N, and estimating the breaking times for the contact pressures of 1500 N and 300 N based on the obtained approximate expression.

The results shown in FIG. 6 do not show the actual durability for image forming apparatus 100, and simply serve as a guide with respect to the durability performance. However, it is assumed that setting the contact pressure to around 300 N as shown in FIG. 6 significantly increases the durability performance of fixing roller 161*c* in comparison to the contact pressure (1500 N) at the time of image formation. Hence, it is possible to significantly increase the durability performance of fixing roller 161*c* by causing fixing belt 161*a* and pressure roller 161*d* to contact at the time of a warm-up operation at a contact pressure that is lower than a contact pressure therebetween at the time of image formation.

As described in detail above, according to Embodiment 1, at the time of a warm-up operation of image forming apparatus 100, if the temperature of pressure roller 161*d* is significantly lower than a target temperature for a time of image formation, fixing belt 161*a* and fixing roller 161*c* are caused to contact with pressure roller 161*d* until the temperature of pressure roller 161*d* reaches a temperature that is close to the target temperature. More specifically, fixing belt 161*a* and fixing roller 161*c* are caused to contact with pressure roller 161*d* at a contact pressure (for example, 300 N) that is lower than a contact pressure (for example, 1500 N) therebetween at a time of image formation.

According to Embodiment 1 that is configured as described above, a difference between the temperature of pressure roller 161*d* and the temperature of fixing belt 161*a* and fixing roller 161*c* when starting printing is reduced and thus the occurrence of a fixing failure can be prevented. Further, at the time of a warm-up operation, since fixing belt 161*a* and fixing roller 161*c* contact with pressure roller 161*d* at a load that is smaller than at a normal time (a time of image formation), it is difficult for a deterioration in the durability of fixing belt 161*a* and fixing roller 161*c* to occur. Thus, a fixing failure of a toner image can be prevented, and a deterioration in the durability of a heating member can be reduced.

Figure 7:
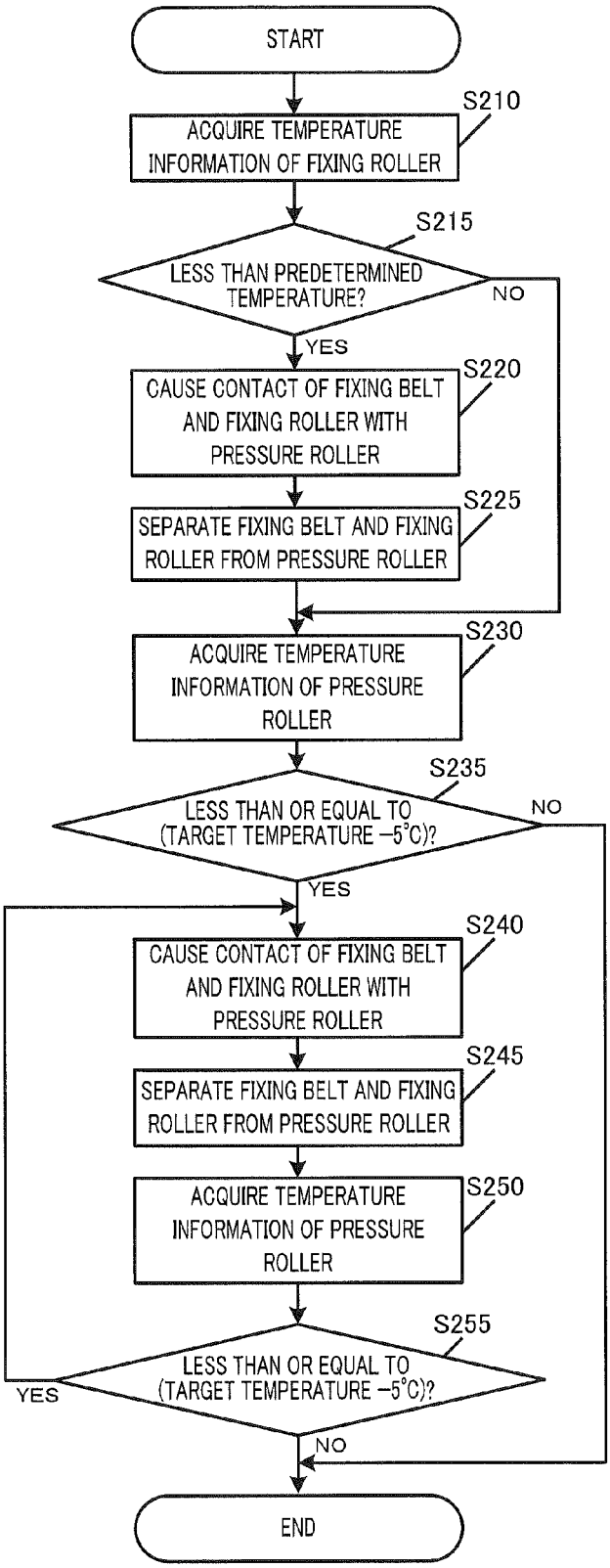
FIG. 7 is a flowchart showing a modification of operations of the image forming apparatus that illustrates Embodiment 1 according to the present invention.

In the above described Embodiment 1, at the time of a warm-up operation, as shown in FIG. 4, when a temperature detection value of temperature sensor 230 that is provided so as to come in contact with the cored bar of fixing roller 161*c* is less than a predetermined temperature, fixing belt 161*a* and fixing roller 161*c* may be caused to contact with pressure roller 161*d* at a contact pressure that is approximately identical to a contact pressure at which fixing belt 161*a* and fixing roller 161*c* contact with pressure roller 161*d* at a time of image formation. The term "predetermined temperature" refers to, for example, a temperature calculated by adding 8° C. to a temperature detection value of temperature sensor 240 that is arranged on the outer surface of image forming apparatus 100 and detects the external air temperature. FIG. 7 is a flowchart showing an example of operations of image forming apparatus 100 at the time of a warm-up operation of image forming apparatus 100. It is assumed that heating of fixing belt 161*a* by halogen heater 161*e* is started before performing the processing in step S210.

First, control section 200 acquires temperature information of fixing roller 161*c* that is outputted from temperature sensor 230 (step S210). Next, control section 200 determines whether or not the temperature indicated by the acquired temperature information is less than a predetermined temperature (step S215). For example, immediately after the power of image forming apparatus 100 is turned on first thing in the morning, or immediately after the power of image forming apparatus 100 is turned on at night after turning off the power thereof in the daytime during winter, in other words, a situation in which the fixing unit 161 has become quite cold in the outside air, such as when a long time has elapsed after power-off of image forming apparatus 100, may be mentioned as a situation in which the temperature of fixing roller 161*c* is less than the predetermined temperature.

If control section 200 determines that the indicated temperature is not less than the predetermined temperature (NO in step S215), the processing transitions to step S230. In contrast, if control section 200 determines that the indicated temperature is less than the predetermined temperature (YES in step S215), control section 200 controls driving section 190 to cause fixing belt 161*a* and fixing roller 161*c* to contact with pressure roller 161*d* for 60 seconds at a contact pressure that is approximately the same as a contact pressure (for example, 1500 N) at which fixing belt 161*a* and fixing roller 161*c* contact with pressure roller 161*d* at a time of image formation (step S220).

Next, control section 200 controls driving section 190 to separate fixing belt 161*a* and fixing roller 161*c* from pressure roller 161*d* (step S225). Thereafter, the processing transitions to step S230.

In step S230, control section 200 acquires temperature information of pressure roller 161*d* that is outputted from temperature sensor 180 (step S230). Next, control section 200 determines whether or not the temperature indicated by the acquired temperature information is less than or equal to a temperature obtained by subtracting 5° C. from the target temperature of pressure roller 161*d* at a time of image formation (step S235).

If control section 200 determines that the indicated temperature is not less than or equal to the temperature obtained by subtracting 5° C. from the target temperature (NO in step S235), image forming apparatus 100 ends the processing illustrated in FIG. 7. In contrast, if control section 200 determines that the indicated temperature is less than or equal to the temperature obtained by subtracting 5° C. from the target temperature (YES in step S235), control section 200 controls driving section 190 to cause fixing belt 161*a* and fixing roller 161*c* to contact with pressure roller 161*d* for 30 seconds at a contact pressure (for example, 300 N) that is lower than a contact pressure at which fixing belt 161*a* and fixing roller 161*c* contact with pressure roller 161*d* at a time of image formation (step S240).

Next, control section 200 controls driving section 190 to separate fixing belt 161*a* and fixing roller 161*c* from pressure roller 161*d* (step S245). Subsequently, control section 200 acquires temperature information of pressure roller 161*d* that is outputted from temperature sensor 180 (step S250). Next, control section 200 determines whether or not the temperature indicated by the acquired temperature information is less than or equal to the temperature obtained by subtracting 5° C. from the target temperature of pressure roller 161*d* at a time of image formation (step S255).

If control section 200 determines that the indicated temperature is less than or equal to the temperature obtained by subtracting 5° C. from the target temperature (YES in step S255), the processing transitions to step S240. In contrast, if control section 200 determines that the indicated temperature is not less than or equal to the temperature obtained by subtracting 5° C. from the target temperature (NO in step S255), since it can be considered that pressure roller 161*d* has reached a temperature that will not significantly decrease the temperature of fixing belt 161*a* even if pressure roller 161*d* contacts fixing belt 161*a* thereafter, image forming apparatus 100 ends the processing illustrated in FIG. 7.

In the flowchart in FIG. 7, in a case where a temperature detection value of pressure roller 161*d*, instead of fixing roller 161*c*, is less than the predetermined temperature, fixing belt 161*a* and fixing roller 161*c* may be caused to contact with pressure roller 161*d* at a contact pressure that is approximately the same as a contact pressure with which fixing belt 161*a* and fixing roller 161*c* contact with pressure roller 161*d* at a time of image formation. Further, if it is possible to use an elapsed time after power-off of image forming apparatus 100 to estimate how much the temperature of fixing roller 161*c* decreases, a configuration may be adopted in which a determination regarding whether or not to cause fixing belt 161*a* and fixing roller 161*c* to contact with pressure roller 161*d* at a contact pressure that is approximately the same as a contact pressure therebetween at a time of image formation is made in accordance with whether or not the elapsed time in question is greater than or equal to a predetermined time. In this case, it is assumed that environmental temperatures will differ according to the country in which image forming apparatus 100 is used, and that how much the temperature of fixing roller 161*c* decreases will differ depending on the country in which image forming apparatus 100 is used, even if the elapsed time after power-off is the same. Therefore, it is preferable to change the elapsed time after power-off that is employed for determining whether or not to cause fixing belt 161*a* and fixing roller 161*c* to contact with pressure roller 161*d* at a contact pressure that is approximately the same as a contact pressure therebetween at a time of image formation in accordance with the environmental temperature of the country in which image forming apparatus 100 is used.

By performing the processing shown in FIG. 7, in comparison with a case in which the processing shown in FIG. 5 is performed, it is possible to raise the temperature of pressure roller 161*d* in a shorter time and consequently a time period required for a warm-up operation can be shortened. Accordingly, the occurrence of a fixing failure can be prevented to a greater degree when performing a fixing operation from a state in which fixing unit 161 is cold, such as first thing in the morning.

Although in the above Embodiment 1 an example is described in which fixing belt 161*a* and fixing roller 161*c* are caused to contact with pressure roller 161*d* for 30 seconds at the time of a warm-up operation, the present invention is not limited thereto. For example, as shown in FIG. 8, a contact time period may be determined according to a difference ΔT between a target temperature of pressure roller 161*d* for a time of image formation and the current temperature of pressure roller 161*d*. In this case, in order to ensure that the temperature of pressure roller 161*d* reaches a temperature that is close to the target temperature as quickly as possible, it is preferable to lengthen the contact time period as the difference ΔT increases.

In addition, when causing fixing belt 161*a* and fixing roller 161*c* to contact with pressure roller 161*d*, the rate of increase in the temperature of pressure roller 161*d* decreases as the temperature of pressure roller 161*d* rises. Therefore, for example, a configuration may be adopted so that, when the target temperature of pressure roller 161*d* exceeds 100° C., a time obtained by adding 30 seconds to the relevant contact time period shown in FIG. 8 is determined as the contact time period, so that the temperature of pressure roller 161*d* reaches a temperature that is close to the target temperature as quickly as possible.

In the above described Embodiment 1, as illustrated in FIGS. 4 and 9, a contact time period for which fixing belt 161*a* and fixing roller 161*c* contact with pressure roller 161*d* may be determined in accordance with a detection result of temperature sensor 230 that is provided so as to contact the cored bar of fixing roller 161*c*. In this case, since the rate of temperature increase of pressure roller 161*d* that contacts with fixing roller 161*c* increases as the temperature of the cored bar of fixing roller 161*c* rises, it is preferable to shorten the contact time period as the cored bar temperature increases.

Although according to the above Embodiment 1 an example is described in which fixing belt 161*a* and fixing roller 161*c* are caused to contact with pressure roller 161*d* at a contact pressure of 300 N at the time of a warm-up operation of image forming apparatus 100, the present invention is not limited thereto. When deterioration in the durability of fixing belt 161*a* and fixing roller 161*c* is taken into consideration, it is preferable to cause fixing belt 161*a* and fixing roller 161*c* to contact with pressure roller 161*d* at a lower contact pressure, and thus a configuration may also be adopted that causes fixing belt 161*a* and fixing roller 161*c* to contact with pressure roller 161*d* in a state that is close to an abutting state.

Embodiment 2

Hereunder, Embodiment 2 of the present invention is described in detail based on the accompanying drawings. The basic configuration of image forming apparatus 100 is the same as Embodiment 1, and hence a description thereof is omitted here.

Figure 10:
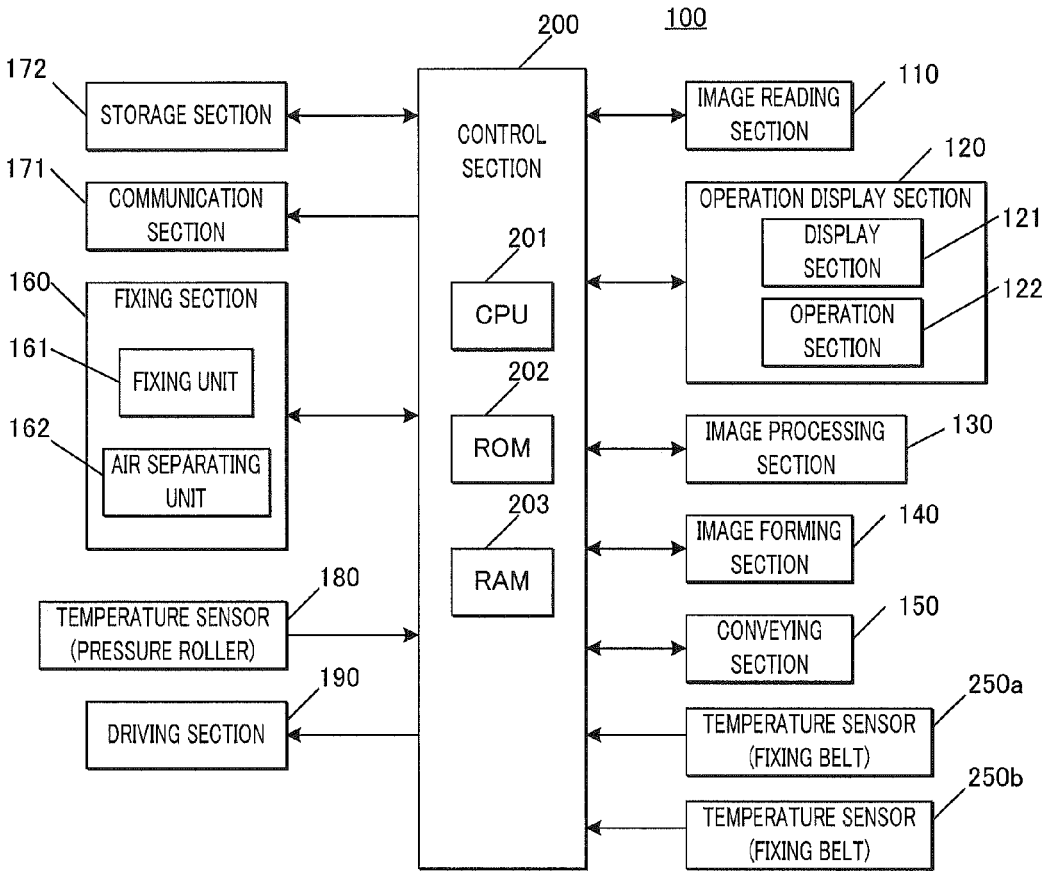
FIG. 10 is a control block diagram of an image forming apparatus that illustrates Embodiment 2 according to the present invention.
Figure 11:
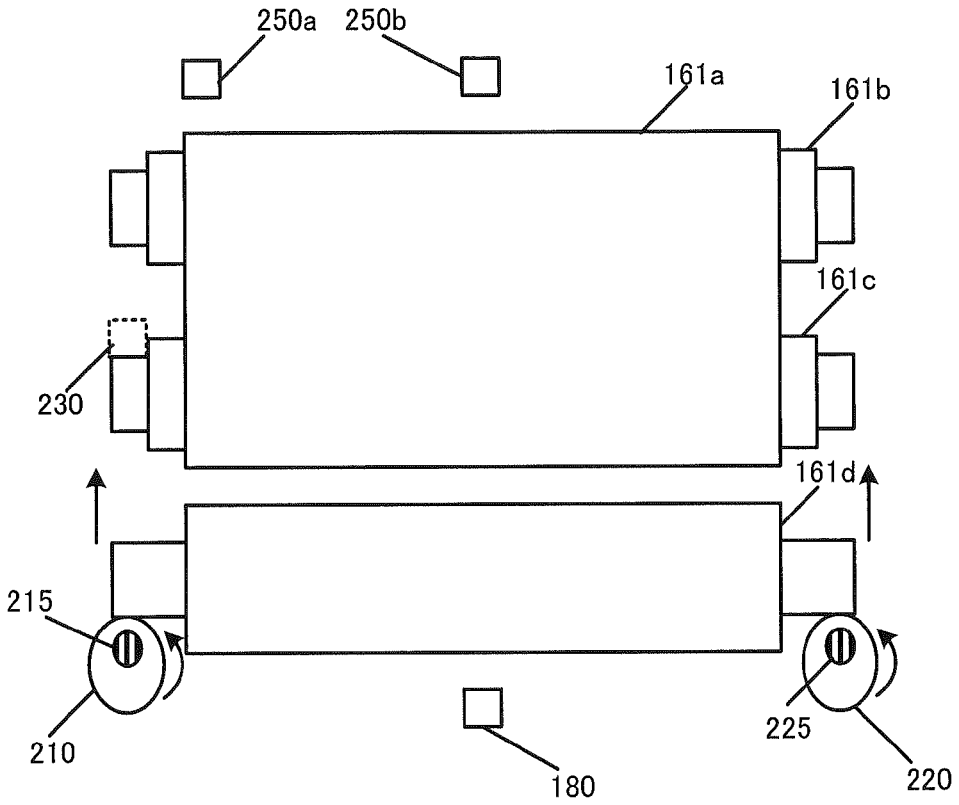
FIG. 11 shows a configuration in the vicinity of a fixing unit that illustrates Embodiment 2 according to the present invention.
Figure 12:
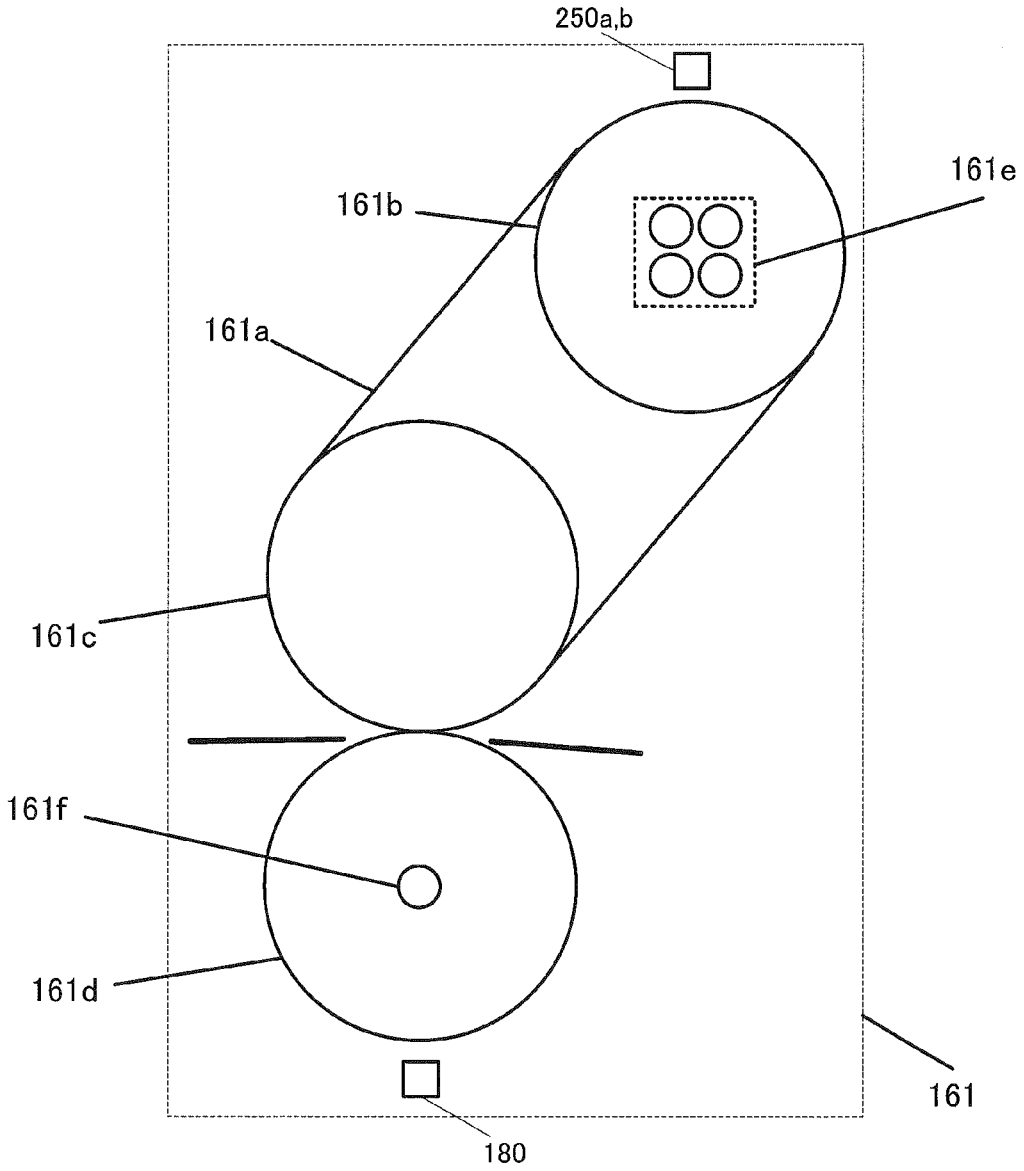
FIG. 12 shows a configuration in the vicinity of a fixing unit that illustrates Embodiment 2 according to the present invention.

As shown in FIGS. 10 to 12, in addition to the configuration illustrated in FIG. 2, image forming apparatus 100 includes temperature sensors 250*a* and 250*b*. Temperature sensor 250*a* is provided above fixing belt 161*a* and heating roller 161*b* at a position that is on the left in the sheet width direction in the drawing. Temperature sensor 250*b* is provided above fixing belt 161*a* and heating roller 161*b* at a position that is at the center in the sheet width direction in the drawing.

Temperature sensor 250*b* detects a temperature at a central part in the sheet width direction of fixing belt 161*a*, and outputs the detected temperature information to control section 200. Temperature sensor 250*a* detects a temperature at an end part in the sheet width direction of fixing belt 161*a*, and outputs the detected temperature information to control section 200. Control section 200 calculates an average value of the temperature indicated by the temperature information that is outputted from temperature sensor 250*a* and a temperature indicated by the temperature information that is outputted from temperature sensor 250*b*, and determines the calculated average value to be the temperature of fixing belt 161*a*.

As shown in FIG. 12, pressure roller 161*d* incorporates, for example, a 700-watt halogen heater 161*f*. That is, the temperature raising capacity of halogen heater 161*f* is lower than that of halogen heater 161*e* that is incorporated in heating roller 161*b*. Pressure roller 161*d* is maintained at a predetermined temperature (for example, 100° C.) by halogen heater 161*f* in order to stabilize the temperature of fixing belt 161*a* (suppress heat radiation from fixing belt 161*a*). The temperature of halogen heater 161*f* is controlled by control section 200. Note that halogen heater 161*f* functions as a heating source.

According to the present embodiment, at the time of a warm-up operation of image forming apparatus 100, if the temperature of pressure roller 161*d* is significantly lower than a target temperature for a time of image formation, control section 200 causes fixing belt 161*a* and fixing roller 161*c* to contact with pressure roller 161*d* and also raises the temperature of pressure roller 161*d* by means of halogen heater 161*f* until the temperature of pressure roller 161*d* reaches a temperature that is close to the target temperature. More specifically, control section 200 causes fixing belt 161*a* and fixing roller 161*c* to contact with pressure roller 161*d* at a contact pressure (for example, 300 N) that is lower than a contact pressure (for example, 1500 N) therebetween at a time of image formation.

Figure 13:
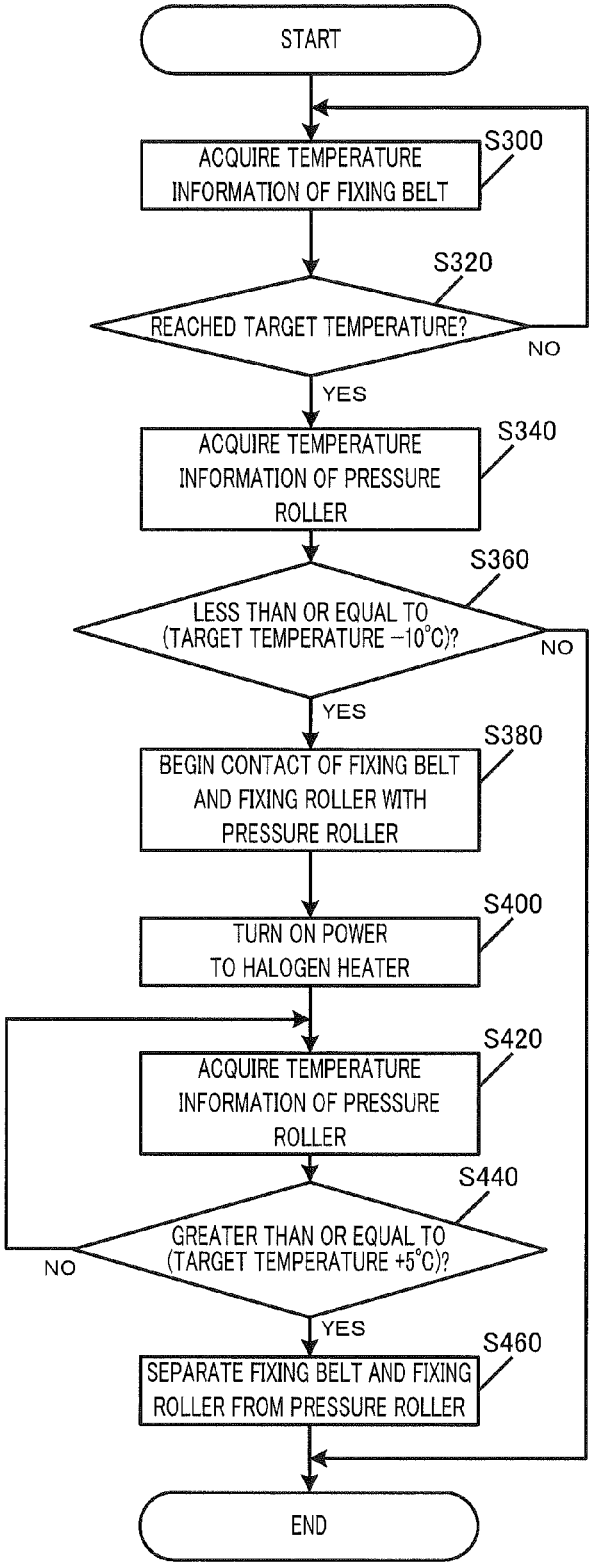
FIG. 13 is a flowchart showing an example of operations of the image forming apparatus that illustrates Embodiment 2 according to the present invention.

FIG. 13 is a flowchart showing an example of operations of image forming apparatus 100 at a time of a warm-up operation of image forming apparatus 100 according to Embodiment 2. It is assumed that heating of fixing belt 161*a* by halogen heater 161*e* is started before performing the processing in step S300.

First, control section 200 acquires temperature information of fixing belt 161*a* that is outputted from temperature sensors 250*a* and 250*b* (step S300). Control section 200 calculates an average value of a temperature indicated by the temperature information outputted from temperature sensor 250*a* and a temperature indicated by the temperature information outputted from temperature sensor 250*b*, and determines the calculated average value to be the temperature of fixing belt 161*a*.

Next, control section 200 determines whether or not the temperature of fixing belt 161*a* has reached a target temperature of fixing belt 161*a* for a time of image formation (step S320). If control section 200 determines that the temperature of fixing belt 161*a* has not reached the target temperature (NO in step S320), the processing transitions to step S300.

In contrast, if control section 200 determines that the temperature of fixing belt 161*a* has reached the target temperature (YES in step S320), control section 200 acquires temperature information of pressure roller 161*d* that is outputted from temperature sensor 180 (step S340). Next, control section 200 determines whether or not a temperature indicated by the acquired temperature information is equal to or less than a temperature obtained by subtracting 10° C. from the target temperature of pressure roller 161*d* for a time of image formation (step S360).

If control section 200 determines that the indicated temperature is not less than or equal to the temperature obtained by subtracting 10° C. from the target temperature (NO in step S360), image forming apparatus 100 ends the processing illustrated in FIG. 13. In contrast, if control section 200 determines that the indicated temperature is less than or equal to the temperature obtained by subtracting 10° C. from the target temperature (YES in step S360), control section 200 controls driving section 190 to cause contact of fixing belt 161*a* and fixing roller 161*c* with pressure roller 161*d* to begin at a contact pressure (for example, 300 N) that is lower than a contact pressure (for example, 1500 N) at which fixing belt 161*a* and fixing roller 161*c* contact with pressure roller 161*d* at a time of image formation (step S380).

Next, to improve the rate of temperature increase of pressure roller 161*d*, control section 200 turns on the power to halogen heater 161*f* (step S400). Subsequently, control section 200 acquires temperature information of pressure roller 161*d* that is outputted from temperature sensor 180 (step S420). Next, control section 200 determines whether or not a temperature indicated by the acquired temperature information is greater than or equal to a temperature obtained by adding 5° C. to the target temperature of pressure roller 161*d* for a time of image formation (step S440).

If control section 200 determines that the indicated temperature is not greater than or equal to the temperature obtained by adding 5° C. to the target temperature (NO in step S440), the processing transitions to step S420. In contrast, if control section 200 determines that the indicated temperature is greater than or equal to the temperature obtained by adding 5° C. to the target temperature (YES in step S440), control section 200 controls driving section 190 to separate fixing belt 161*a* and fixing roller 161*c* from pressure roller 161*d* (step S460). Upon completing the processing in step S460, image forming apparatus 100 ends the processing illustrated in FIG. 13.

Figure 14:
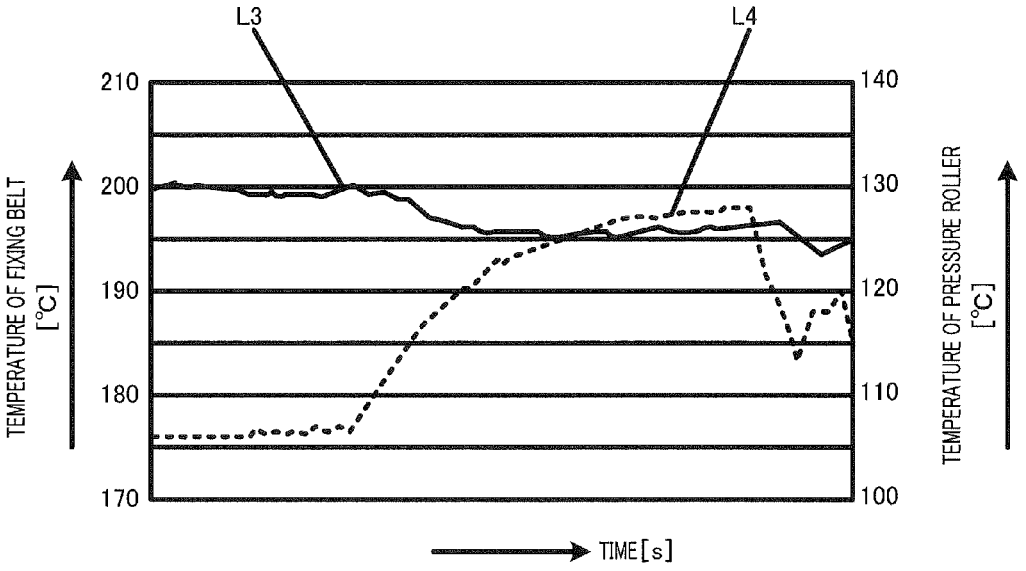
FIG. 14 illustrates a temperature change of a fixing belt and a temperature change of a pressure roller.
Figure 15:
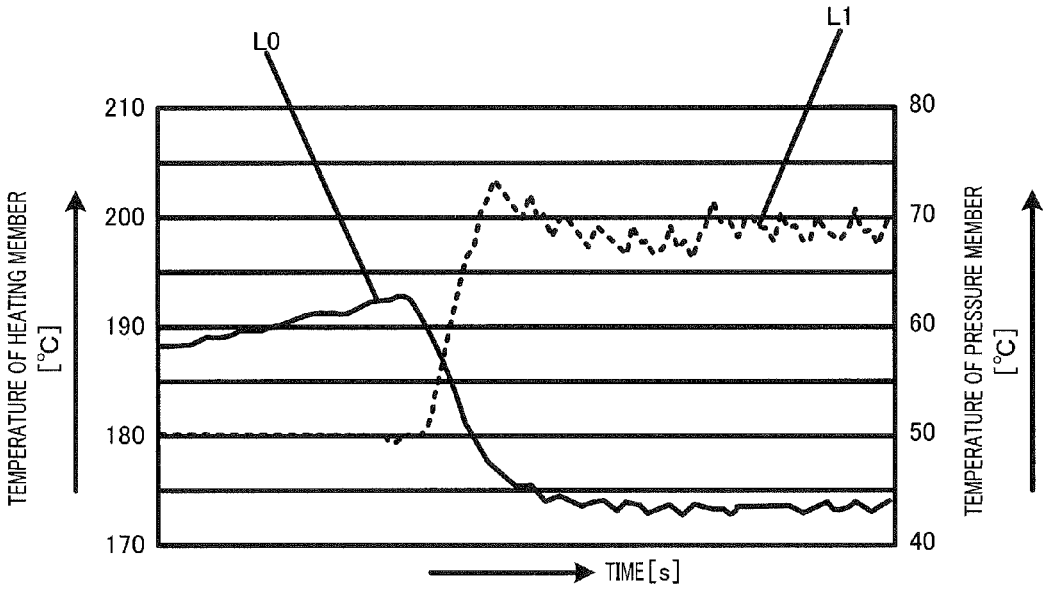
FIG. 15 illustrates a temperature change of a heating member and a temperature change of a pressure member according to the conventional technology.

FIG. 14 illustrates a temperature change in fixing belt 161*a* and a temperature change in pressure roller 161*d* with respect to before and after fixing belt 161*a* and fixing roller 161*c* are caused to contact with pressure roller 161*d* immediately after performing a warm-up operation of image forming apparatus 100. In FIG. 14, curve L3 represents a temperature change in fixing belt 161*a*. Curve L4 represents a temperature change in pressure roller 161*d*. In the example illustrated in FIG. 14, immediately after the warm-up operation, the temperature of pressure roller 161*d* is a high temperature of approximately 105° C. Accordingly, if fixing belt 161*a* and fixing roller 161*c* are caused to contact with pressure roller 161*d*, a decrease in the temperature of fixing belt 161*a* can be suppressed to about 5° C. and occurrence of a fixing failure can be prevented.

As described in detail above, according to Embodiment 2, at the time of a warm-up operation of image forming apparatus 100, if the temperature of pressure roller 161*d* is significantly lower than a target temperature for a time of image formation, fixing belt 161*a* and fixing roller 161*c* are caused to contact with pressure roller 161*d* and the temperature of pressure roller 161*d* is also raised by means of halogen heater 161*f* until the temperature of pressure roller 161*d* reaches a temperature that is close to the target temperature. Thus, in addition to the advantageous effects described in Embodiment 1, it is possible to raise the temperature of pressure roller 161*d* in a short time, and consequently a time period of the warm-up operation can be shortened further.

Although in the above Embodiment 2 an example is described in which a state in which fixing belt 161*a* and fixing roller 161*c* contact with pressure roller 161*d* is maintained until the temperature of pressure roller 161*d* reaches a temperature that is close to the relevant target temperature, the present invention is not limited thereto. For example, as in Embodiment 1, a configuration may be adopted in which processing that brings fixing belt 161*a* and fixing roller 161*c* in contact with pressure roller 161*d* for a predetermined time period and then separates fixing belt 161*a* and fixing roller 161*c* therefrom is repeated until the temperature of pressure roller 161*d* reaches a temperature that is close to the relevant target temperature. In this case, a time period for which fixing belt 161*a* and fixing roller 161*c* contact with pressure roller 161*d* may be determined in accordance with a detection result of temperature sensor 230 that is provided so as to contact the cored bar of fixing roller 161*c*.

Although in the foregoing Embodiments 1 and 2 examples are described in which, at the time of a warm-up operation, fixing belt 161*a* and fixing roller 161*c* are caused to contact with pressure roller 161*d* at a contact pressure that is lower than a contact pressure at a time of image formation, the present invention is not limited thereto. For example, at a time of an idling operation (standby operation) after a warm-up operation is completed, fixing belt 161*a* and fixing roller 161*c* may be caused to contact with pressure roller 161*d* at a contact pressure that is lower than a contact pressure at a time of image formation or at a contact pressure that is approximately identical to the contact pressure at a time of image formation. According to this configuration, when starting printing after an idling operation ends also, the difference between the temperature of fixing belt 161*a* and fixing roller 161*c* and the temperature of pressure roller 161*d* is small, and occurrence of a fixing failure can be prevented.

Further, although in the foregoing Embodiments 1 and 2 examples are described in which fixing belt 161*a* and fixing roller 161*c* are caused to contact with pressure roller 161*d* by moving pressure roller 161*d* to the side of fixing belt 161*a*, the present invention is not limited thereto. For example, a configuration may also be adopted in which fixing belt 161*a* is moved to the side of pressure roller 161*d*. In addition, a configuration may be adopted in which pressure roller 161*d* and fixing belt 161*a* are moved so as to approach each other.

Although in the foregoing Embodiments 1 and 2 it is assumed that fixing unit 161 that adopts a belt heating system is used, the present invention is not limited thereto. For example, fixing unit 161 may be constituted by a fixing roller that has a heating source and a pressure roller.

It is to be understood that the foregoing Embodiments 1 and 2 are intended to merely illustrate specific examples for implementing the present invention, and are not intended to limit the technical scope of the present invention. That is, the present invention can be implemented in various forms without departing from the spirit of the invention or the principal features thereof.

What is claimed is:

1. An image forming apparatus, comprising:

a heating member that heats a recording sheet;

a pressure member that presses the recording sheet between the heating member and the pressure member;

an adjustment mechanism that causes the heating member and the pressure member to contact or separate; and a control section that, at a time of a warm-up operation or an idling operation, if an elapsed time after power-off of the image forming apparatus is greater than or equal to a predetermined time, controls the adjustment mechanism so as to cause the heating member and the pressure member to contact at a contact pressure that is lower than a contact pressure between the heating member and the pressure member at a time of image formation or is approximately identical to the contact pressure at a time of image formation, while if the elapsed time is less than the predetermined time, the control section controls the adjustment mechanism so as to cause the heating member and the pressure member to contact at a contact pressure that is lower than a contact pressure between the heating member and the pressure member at a time of image formation.

2. The image forming apparatus according to claim 1, further comprising a heating source that heats the pressure member, wherein the control section turns on power to the heating source at a time of the warm-up operation or the idling operation.

3. A control method of an image forming apparatus that comprises:

a heating member that heats a recording sheet;

a pressure member that presses the recording sheet between the heating member and the pressure member; and an adjustment mechanism that causes the heating member and the pressure member to contact or separate;

wherein at a time of a warm-up operation or an idling operation, if an elapsed time after power-off of the image forming apparatus is greater than or equal to a predetermined time, a control section controls the adjustment mechanism so as to cause the heating member and the pressure member to contact at a contact pressure that is lower than a contact pressure between the heating member and the pressure member at a time of image formation or is approximately identical to the contact pressure at a time of image formation, while if the elapsed time is less than the predetermined time, the control section controls the adjustment mechanism so as to cause the heating member and the pressure member to contact at a contact pressure that is lower than a contact pressure between the heating member and the pressure member at a time of image formation.

4. The control method according to claim 3, wherein the image forming apparatus comprises a heating source that heats the pressure member, and the control section turns on power to the heating source at a time of the warm-up operation or the idling operation.

* * * * *